United States Patent [19]

Tsuda et al.

[11] 4,264,190

[45] Apr. 28, 1981

[54] TONER CLEANING DEVICE FOR AN ELECTROPHOTOGRAPHIC APPARATUS

[75] Inventors: Hiroshi Tsuda, Mitaka; Kiyoshi Miyashita; Masaji Nishikawa, both of Hachioji; Akira Shimizu, Fuchu; Muneo Kasuga, Hachioji, all of Japan

[73] Assignee: Olympus Optical Co., Ltd., Tokyo, Japan

[21] Appl. No.: 29,351

[22] Filed: Apr. 11, 1979

[30] Foreign Application Priority Data

Apr. 18, 1978 [JP] Japan ..... 53-46187

[51] Int. Cl.[3] ..... G03G 21/00

[52] U.S. Cl. ..... 355/15; 15/256.52; 118/652

[58] Field of Search ..... 118/652; 355/15; 15/1.5, 256.51, 256.52

[56] References Cited

U.S. PATENT DOCUMENTS

| | | | |
|---|---|---|---|
| 3,736,055 | 5/1973 | Davidge et al. | 355/14 R |
| 3,819,263 | 6/1974 | Draugelis et al. | 355/15 X |
| 4,158,498 | 6/1979 | Ohmori | 355/15 |

*Primary Examiner*—Richard L. Moses

*Attorney, Agent, or Firm*—Haseltine and Lake

[57] ABSTRACT

A cleaning device for an electrophotographic apparatus including a cleaning brush for cleaning unnecessary residual toner particles adhered to an electrostatic latent image retentive member, a cleaning fan for obtaining an air flow to suck the toner particles scraped by the brush and a filter for collecting the sucked toner particles is disclosed. The cleaning device comprises a path of the air flow for sucking the toner particles being made thick at the vicinity of the filter thereby to slow down a speed of the air flow, to easily catch the toner particles by the filter and to drop down the toner particles in front of the filter, and a toner reservoir being provided for collecting the toner particles dropped in front of the filter.

4 Claims, 7 Drawing Figures

TONER CLEANING DEVICE FOR AN ELECTROPHOTOGRAPHIC APPARATUS

BACKGROUND OF THE INVENTION

The present invention relates to a cleaning device for cleaning toner particles remained after developing and transferring an electrostatic latent image retentive member by toner particles in an electrophotographic apparatus.

In a dry electrophotographic apparatus using toner particles there are proposed various methods of cleaning toner particles remained after transferring a toner image formed on an electrostatic latent image retentive member onto a recording medium. The method comprises a combination of a cleaning brush rotated adjacent to the recording medium and an absorbing device for sucking toner particles scraped by the brush. In this case a filter is used for collecting the toner particles scraped by the brush from the retentive member without dispersing outside and inside of the apparatus. It is, however, most important that maintenance of the filter should be easy, cleaning of the toner cleaning device and exchange of parts should be easy and mechanism should be simple. Conventional cleaning devices could not satisfy these requirements. Moreover, in case of obtaining a plurality of duplicated copies from one exposure by repeatedly toner-developing and transferring the same electrostatic latent image, it is necessary to make the cleaning device inactive during multiple copying.

SUMMARY OF THE INVENTION

It is an object of the present invention to eliminate the above described disadvantages.

It is another object of the present invention to provide a cleaning device in which whole mechanism of the device is simple, maintenance thereof is easy, that is, cleaning and exchange of parts are easy and a cycle of maintenance can be elongated.

It is a further object of the present invention to provide a cleaning device which can freely start and stop the cleaning action and is suitable for multiple copying.

It is a still further object of the present invention to provide a cleaning device which can make collection of toner particles easy and can lessen lowering of filtering ability.

According to the present invention a cleaning device for an electrophotographic apparatus comprises a cleaning brush rotated adjacent to an electrostatic latent image retentive member for cleaning unnecessary residual toner particles adhered to the electrostatic latent image retentive member, a cleaning fan for obtaining an air flow to suck the toner particles scraped by the cleaning brush, a filter for collecting the sucked toner particles, a path of the air flow for sucking the toner particles being made thick at the vicinity of the filter thereby to slow down a speed of the air flow, to easily catch the toner particles by the filter and to drop the toner particles in front of the filter, and a toner particle reservoir being provided for collecting the toner particles dropped in front of the filter.

The filter comprises at least two coarse and fine filters aligned alternatively in the direction of the air flow thereby to increase a collecting efficiency of the toner particle. A space is provided between the coarse and the fine filters. The coarse and the fine filters are integrally accommodated in a supporting frame.

The cleaning device also comprises swinging arms for rotatably securing the cleaning brush thereby to stop cleaning operation by separating the cleaning brush from the latent image retentive member when the same latent image is repeatedly used to obtain a plurality of duplicated copies, and means for detachably mounting the brush on the arms to make the cleaning brush exchangeable. The arms are respectively provided on both ends of a rotating shaft of the cleaning brush, a bearing of the rotating shaft is mounted on one arm, a motor for rotating the cleaning brush is mounted on the other arm, a detachable means is provided for separating the rotating shaft of the motor from the cleaning brush and for coupling the motor with the brush to transmit rotation of the motor, one arm is detachably mounted to its pivot shaft, this arm, the cleaning brush and the rotating shaft of the cleaning brush are integrally detached from the cleaning device, and the cleaning brush is taken out of the rotating shaft thereof. The cleaning fan has a rotating shaft parallel to a suction inlet of toner particle in the longitudinal direction and a length shorter than that of the suction inlet in the direction of the rotating shaft, a fan motor is coaxially arranged with the cleaning fan, and the cleaning fan and the fan motor are substantially accommodated within a length of the suction inlet.

DESCRIPTION OF THE PREFERRED EMBODIMENTS

Figure 1:
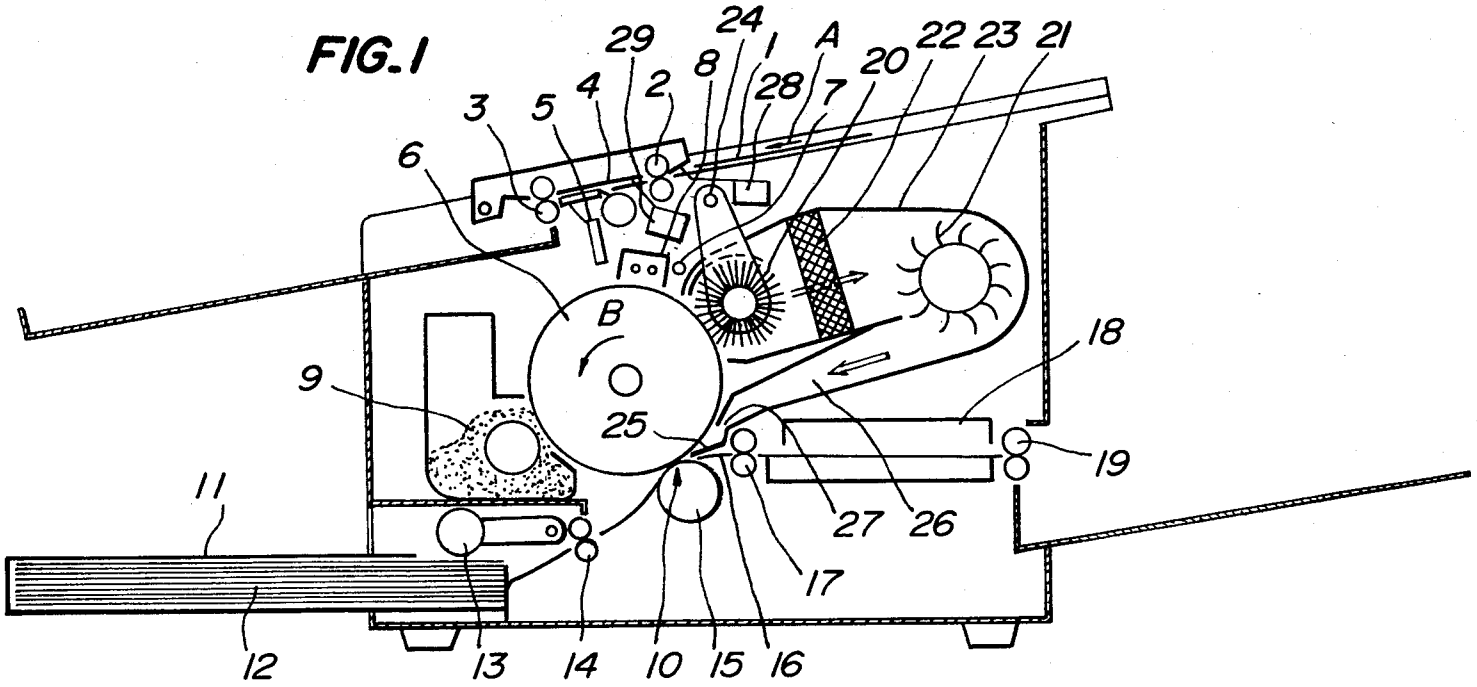
FIG. 1 is a diagrammatic cross-sectional view showing one embodiment of the construction of an electrophotographic apparatus with a cleaning device according to the present invention.

Referring now to drawings, wherein like reference characters designate like or corresponding parts throughout the several views, one embodiment of construction of an electrophotographic apparatus with a cleaning device according to the present invention will be described.

FIG. 1 is a diagrammatic cross-sectional view showing the construction of a electrophotographic apparatus with a cleaning device according to the present invention. A sheet-like document 1 is placed on a document table and inserted into a sheet-like document feeding device in the direction of an arrow A so that the document 1 is conveyed to a document tray by rollers 2 and 3. During this conveying operation the document 1 is illuminated by an illumination lamp 4 and then the document image is projected onto a rotating photosensitive drum 6 by an optical system 5. The drum 6 is rotated in the direction of an arrow B and subjected to a formation of an electrostatic latent image by the light image projection. In this case the residual charges of the drum 6 are discharged by a lamp 7 and then the drum 6 is uniformly charged by a corona discharger 8 so as to make the latent image ready. The electrostatic latent image is developed with toner particles at a toner developer 9 and conveyed to a toner image transfer section 10 according to rotation of the drum 6. A recording paper 12 accommodated in a cassette for the recording paper is picked up one by one by means of a pick-up roller 13 and conveyed to the transfer section 10 by rollers 14. At the transfer section the recording paper 12 is conveyed between the drum 6 and a transfer roller 15 so as to contact with the toner image so that the toner image is transferred onto the recording paper. In this case the recording paper 12 is conveyed in a condition that it is contacted with the toner image, that is, the drum 6 and then the paper 12 must be peeled from the drum 6. The peeled paper is conveyed along a guide 16 in a fixing device 18 by rollers 17 to fix the transferred toner image therein. The recording paper having the fixed toner image is took out on a paper tray by rollers 19. The toner image developed on the drum 6 is not all transferred on the paper 12 and a part of the toner image is remained on the drum 6 so that the residual toner particles must be brushed away by a rotating cleaning brush 20. The brushed toner particles are sucked in an air flow caused by rotation of a fan 21 and collected by a filter 22. These cleaning brush 20 and fan 21 are enclosed by a duct 23 so as to obtain an effective toner attractive force and to prevent the toner particles being dispersed in the apparatus. When a plurality of same duplicated copies are obtained by toner-developing and transfer processes by repeatedly utilizing electrostatic latent image once formed on the drum 6, it is preferable not to clean the toner image during multiple copying so that the cleaning brush 20 can preferably be separated from the drum 6 by rotating the brush 20 about a pivotal shaft 24. In this embodiment a peeling claw 25 and an air flow blown from an opening 27 through a blowing duct 26 are employed for peeling off the recording paper 12 from the drum 6. A start of the electrophotographic apparatus caused by insertion of the document and an operation of each section in synchronized with the position of the document are performed by detecting the position of the document with microswitches 28 and 29.

Figure 2:
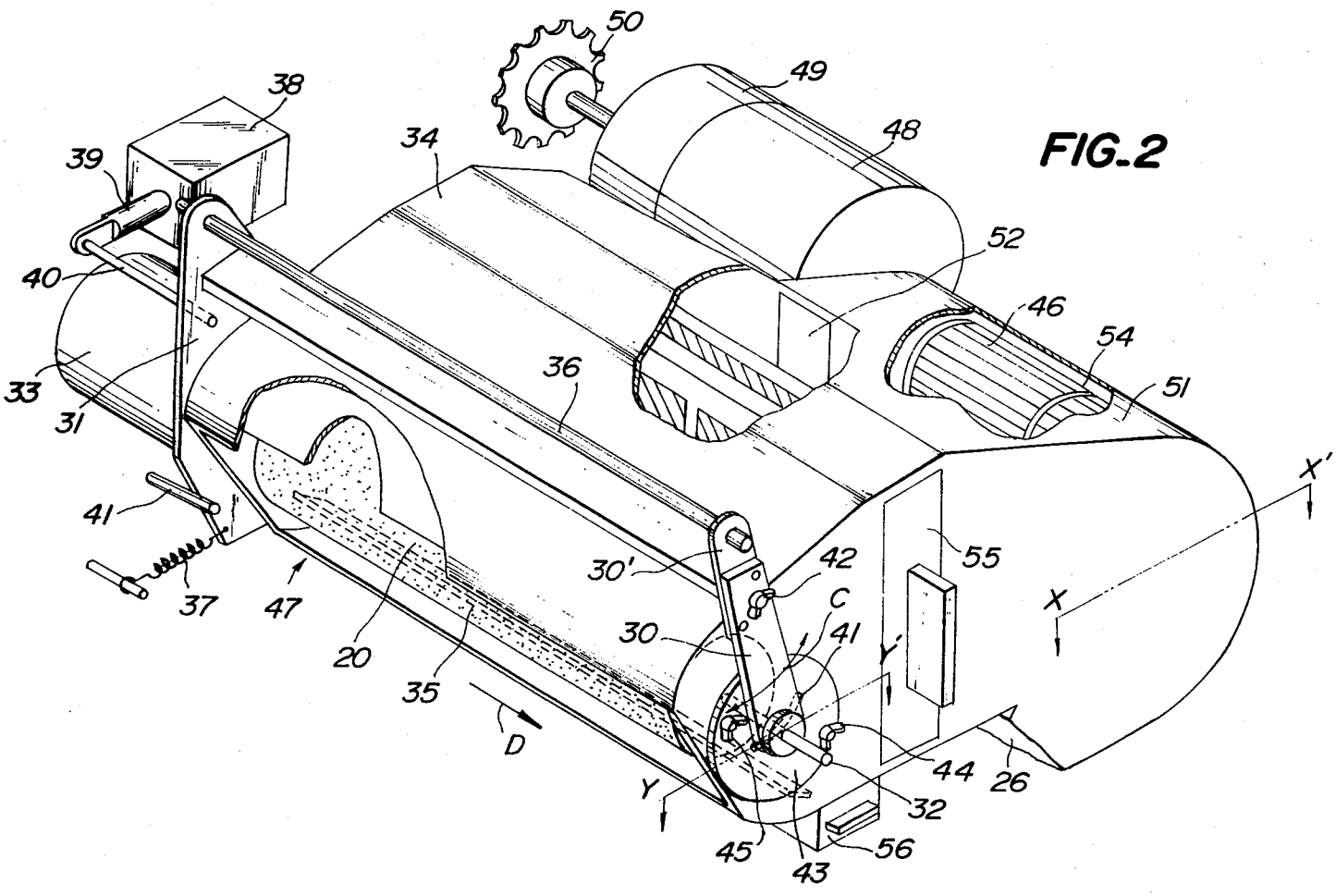
FIG. 2 is a perspective view showing the detailed construction of a cleaning device according to the present invention.

FIG. 2 is a diagram showing the detailed construction of one embodiment of the cleaning device according to the invention having a brush suitable for the above multiple copying and approachable and separable to the drum 6. The cleaning brush 20 is so constructed that it is simultaneously rotated with a rotating shaft 32 secured to an arm 30 and an arm 31. To this end a motor 33 is secured to the arm 31. The brush 20 is accommodated in a duct 34, the duct 34 is provided with a sweep plate 35 for sweeping the brush 20 with the toner adhered thereto and for dropping the toner particles into the duct 34 (refer to FIG. 7). The arms 30 and 31 are swung in the direction of an arrow C around a shaft 36 secured to a fixed member (not shown), thereby to separate the brush 20 from the drum 6 as described above, but it is preferable to bring the brush 20 into contact with the sweep plate 35 at either position. The arms 30 and 31 are coupled to each other by a stay parallel to the shaft 36.

The arm 31 is biased to the side of the drum 6 (FIG. 1) by means of a spring 37 and the cleaning brush 20 is made into contact with the drum 6. When the cleaning brush 20 is separated from the drum 6, a solenoid 38 is energized and the arm 31 is pulled against the spring 37 through a plunger 39 and a pin 40. In addition, reference numeral 41 is a stopper for defining an amount of the cleaning brush 20 made into contact with the drum 6. Since the arms 30 and 31 are provided outside the duct 34, the rotating shaft 32 of the brush 20 is extended through the side wall of the duct 34, and a through-hole 41 is arcuately opened for making movement of the brush 20 possible. It is preferable to make the brush 20 removable for cleaning or exchanging when necessary, and in the present embodiment, the brush 20 is removable in the direction of an arrow D. For this purpose, the auxiliary arm 30 is made removable from an arm 20' fixed to the shaft 36 by removing a thumb screw 42, while a lid 43 is provided in the duct 34, and the lid 43 can be removed by releasing thumb screws 44 and 45. These mechanisms are described in detail later on.

Figure 3:
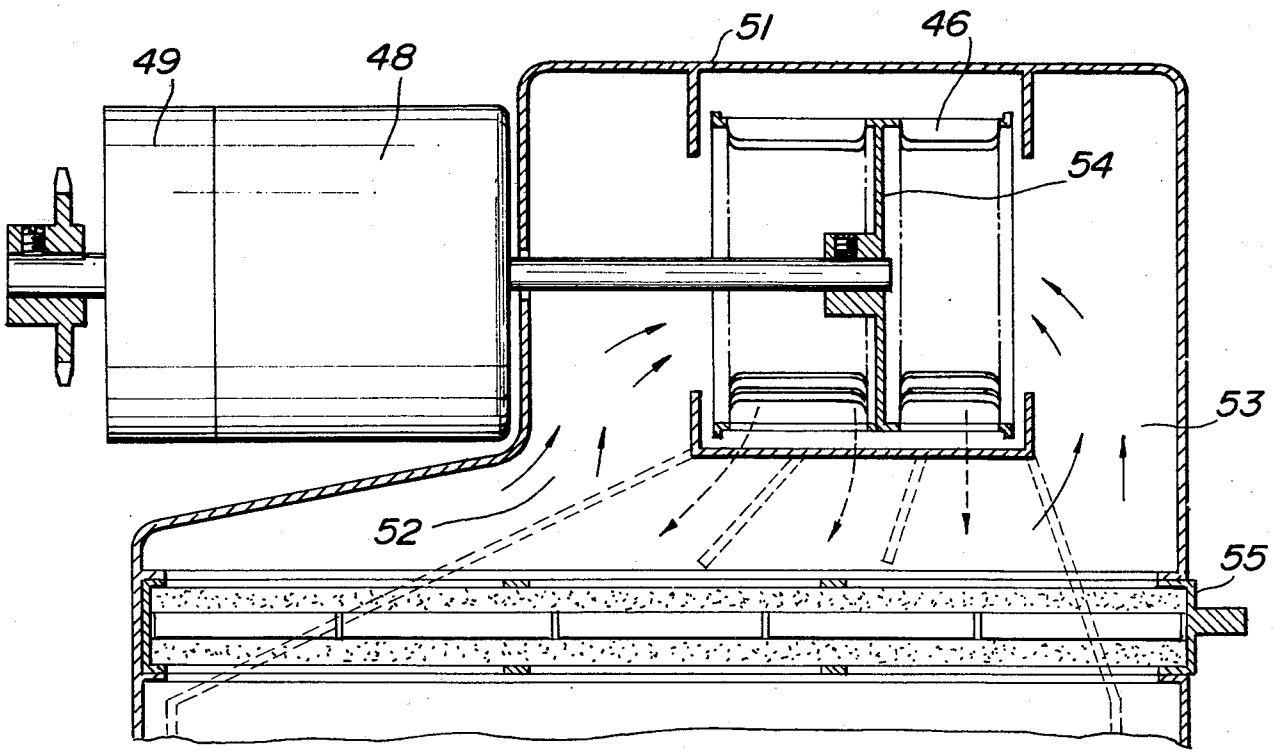
FIG. 3 is a vertical sectional view taken along the line X—X' of the cleaning device shown in FIG. 2.

The duct 34 is provided with a siroco fan 46, thereby sucking toner particles from an opening 47 of the duct 34. In the present embodiment, a motor 48 for rotating the siroco fan 46 is coaxially secured to the fan 46 without taking any space, so that the duct 34 is, as illustrated, made shorter than the opening 47 of the duct 34 in width of a casing 51 of the siroco fan, and the motor 48 is put within the residual dimension of the duct 34. The motor 48 is used as a main motor of the whole electrophotographic apparatus, a sprocket 50 is driven through a reduction gear 49 and power is taken therefrom. FIG. 3 is a vertical sectional view taken along the line X—X' of FIG. 2 showing the structure of the siroco fan 46. As described above, in order to put the motor 48 within the residual dimension of the duct 34, the casing 51 of the fan 46 is deviated from the center of the duct 34 (the right side portion in FIG. 2), so that in order to obtain uniform suction force over the whole width of the opening 47, suction inlets 52 and 53 communicated to the duct 34 are provided on both sides of the siroco fan 46 and a partition 54 is provided at the portion deviated from the center of the siroco fan 46, as the left fan, use is made of that which moving blade is longer and suction force is stronger than those of the right fan, and suction force is stronger than those of the right fan, and suction force from the suction inlet 52 is made larger than that from the suction inlet 53. With the air flow thus obtained, the toner particles scraped from the drum by means of the brush 20 are uniformly sucked into the duct 34 from the opening 47, and collected by a filter 55 provided in front of the fan 46. In this case large toner particles are dropped in front of the filter 55, and stored in a toner reservoir 56, and even small toner particles are collected in the filter 55. The air flow blown from the siroco fan 46 is passed through the duct 26 and used as an air flow for peeling off the above described recording paper in the present embodiment.

Figure 4:
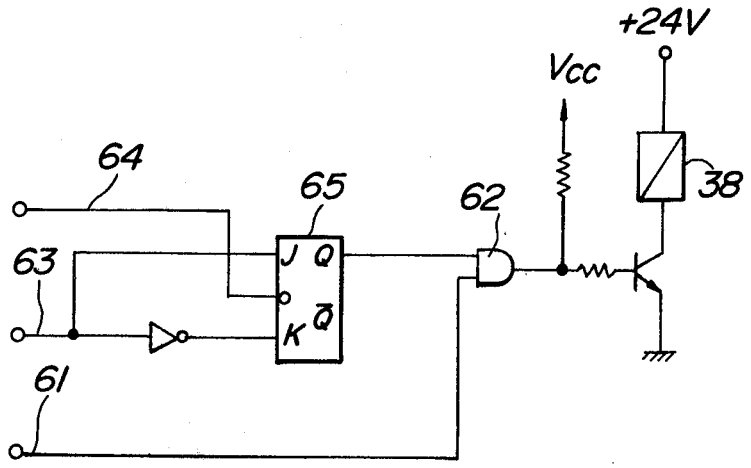
FIG. 4 is a circuit diagram showing a circuit for controlling approach and separation of a cleaning brush to a photosensitive drum.
Figure 5:
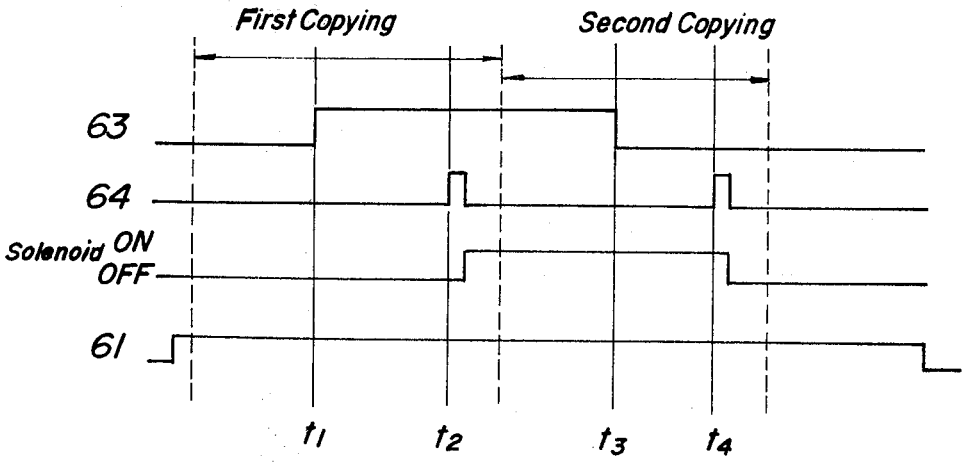
FIG. 5 is a diagram showing operation timing of the circuit shown in FIG. 4.

An approach and separation action of the cleaning brush 20 should be controlled in accordance with the number of copies, and one embodiment of a circuit required therefor is shown in FIG. 4. When the fan 46 and the brush 20 are rotated, a terminal 61 becomes high level and gate 62 is opened. In case of carrying out multiple copying with the use of the same electrostatic latent image, a terminal 63 is made high level. When a counter for counting a residual amount of sheets to be copied shows more than two sheets, the terminal 63 should be high level. FIG. 5 is a diagram showing timing of this circuit operation. For example, in case of copying two sheets by one exposure, on the way of one rotation of the drum, a predetermined number "2" is coded to the counter as an initial value, then at the time of $t_1$ more than two sheet copies are detected, and the terminal 63 becomes high level as described above. Further rotation of the drum, the timing for separating the cleaning brush 20 from the drum 6, i.e., $t_2$, comes and then a timing pulse is applied to the terminal 64, the state of a flip-flop 65 is reversed, a Q output becomes high level and passes through the gate 64 to energize the solenoid 38 (FIG. 2) and then the cleaning brush 20 is separated. The counter counts down at the latter half of one rotation of the drum and detect a remaining copy on the way of two rotations of the drum $t_3$, so as to make the terminal 63 low level. Then at the time $t_4$, i.e., timing for acting the cleaning brush 20, a timing pulse is applied to the terminal 64, the state of the flip-flop 65 is again reversed, the Q output becomes low level, the solenoid 38 is deenergized and a current does not flow therethrough, and the cleaning brush 20 is again made into contact with the drum by the spring 37 (FIG. 2).

Figure 6:
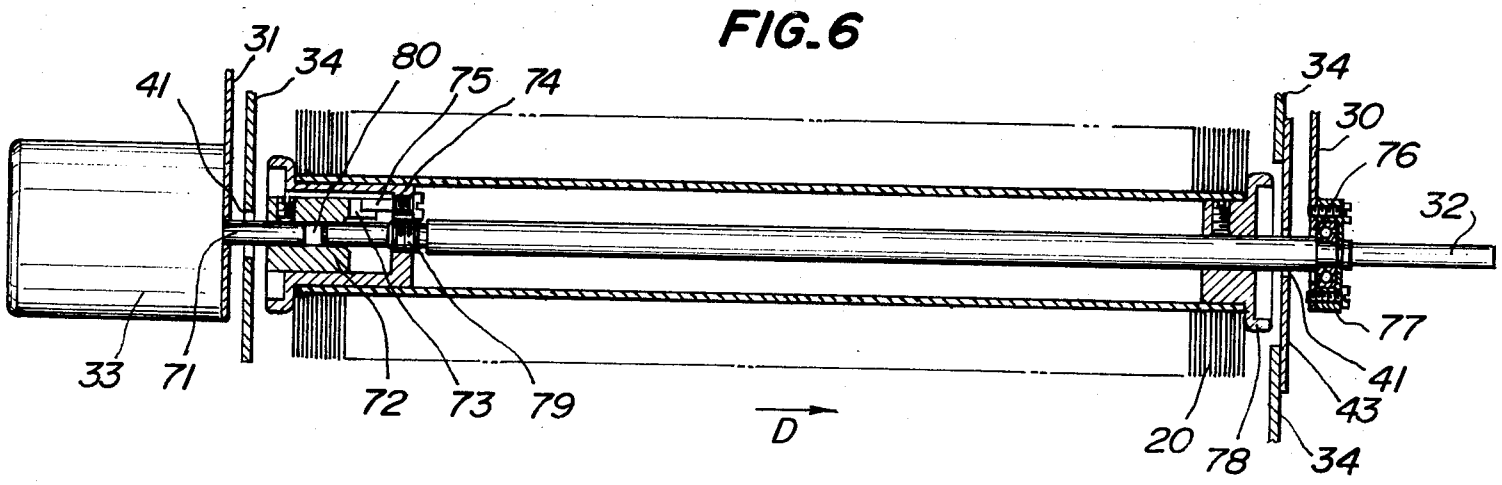
FIG. 6 is a vertical sectional view taken along the line Y—Y' of the cleaning device shown in FIG. 3 and showing the detachable mechanism of the cleaning brush.

The detachable mechanism of the cleaning brush will be explained with reference to FIG. 6. FIG. 6 is a vertical sectional view taken along the line Y—Y' of FIG. 2. A boss 72 is fixed to a shaft 71 of the brush drive motor 33 secured to the auxiliary arm 31. The boss 72 is provided with a projection 73 and is covered with a knob 74 for the brush 20. A pin 75 provided in the knob 74 is engaged with the projection 73 to transmit rotation of the motor 33 to the knob 74. A bearing 76 is fixed to the arm 30 opposite to the motor 33 by a bearing pressure 77, thereby to rotatably support the brush shaft 32. The shaft 32 extends through a slit 41 provided in the lid 43 of the duct 34 as described above, and a stopper 78 is further fixed to the shaft 32. The knob 74 is screwed to the other end side of the shaft 32 by a screw 79 provided thereto, and the end of the shaft 32 is inserted into a recess portion 80 at the center of the boss 72. The hollow cylindrical cleaning brush 20 is sandwiched by the stopper 78 and the knob 74 and fixed to the shaft 32, so that when the motor 33 is rotated, this rotation is transmitted to the knob 74 through the pin 75 and then the knob 74, the shaft 32 and the brush 20 are integrally rotated.

When the brush 20 is exchanged, the thumb screw 42 (FIG. 2) and the thumb screws 44, 45 (FIG. 2) are removed, and the arm 30 and the lid 43 are taken out in the direction of an arrow D together with the shaft 32, the brush 20 and the knob 74. Then the knob 74 is rotated to remove from the shaft 32, and the brush 20 can be removed from the shaft 32.

Figure 7:
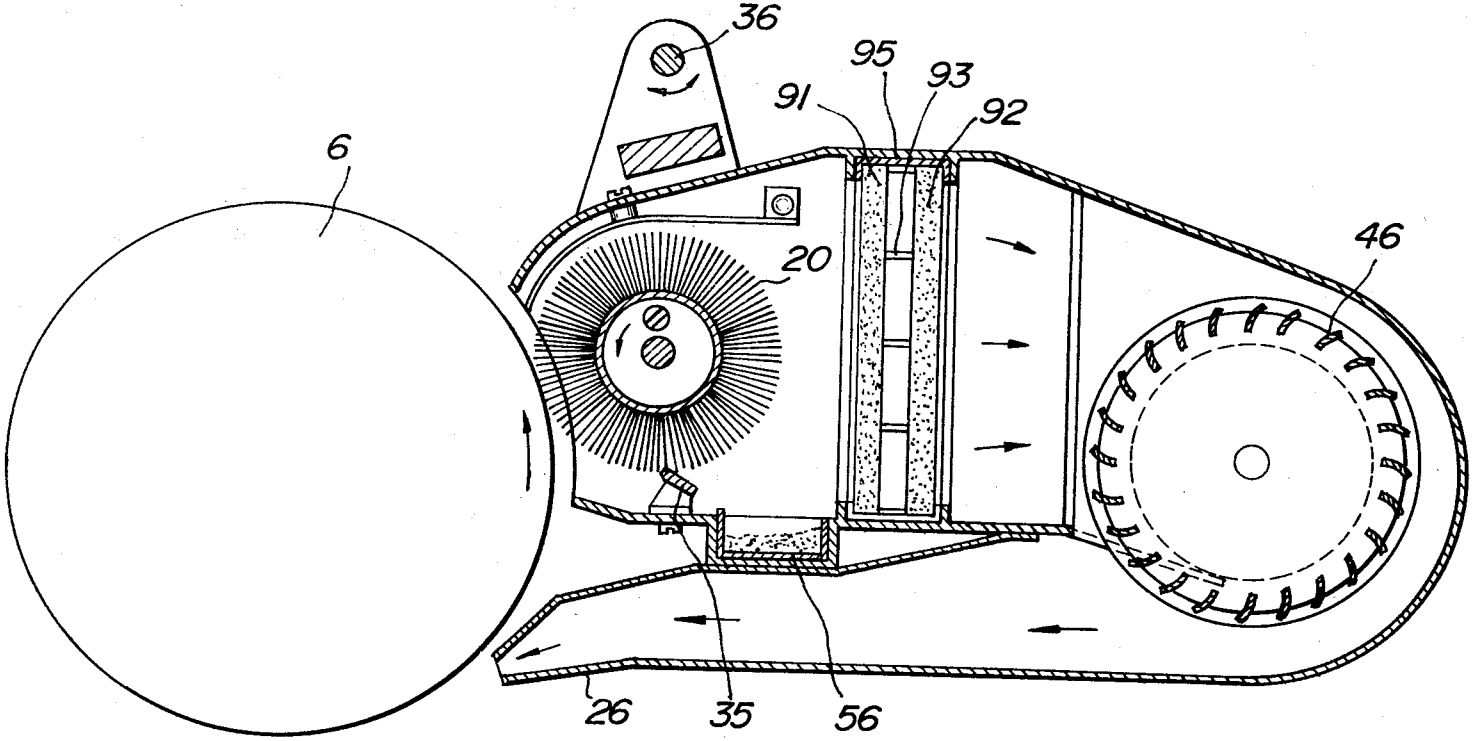
FIG. 7 is a cross-sectional view showing the construction of a filter provided to the cleaning device according to the present invention.

The structure of the filter 55 will be explained with reference to FIG. 7. FIG. 7 is a cross-sectional view of the duct 34, in which a dimension of the duct 34 provided with the filter 55 is made larger than that of the opening 47 provided with the cleaning brush 20. Therefore, a flow speed of the air flow caused by the fan 46 is comparatively slow around the filter 55 and becomes turbulent, so that comparatively large toner particles are dropped in front of the filter 55 and stored in the toner reservoir 56. The toner reservoir 56 can be pulled forward (vertical direction to the plane in FIG. 7), so that the toner particles stored therein are properly thrown away. Since the dimension of the duct is large, a surface area of the filter 55 can be made large. In the present embodiment, use is made of two filter elements 91 and 92 having different densities from each other as a filter 55. As these filter elements, use may be made of, for example, a breathing foam (trade name: Everlight scott). The density of the filter element 91 is coarser than that of the filter element 92, the pore size of the filter element 92 is almost equal to that of the toner particle, so that the comparatively large toner particle can be caught by the filter element 91, while the small toner particle can be caught by the filter element 92. Therefore, the filter element is not clogged and can be used for a long time. Further, a space 94 is provided between the filter elements 91 and 92 by a partition 93, so that a part of the toner particles passed through the filter element 91 is dropped therein to prevent the filter element 92 from clogging. With the provision of such space, the surface area of the filter 55 consists of that of the filter elements 91 and 92, and it means that the surface area twice the same cross section can be obtained. In addition, these filters 91, 92 are supported by a supporting frame 95 and they are integrally pulled out at the time of exchange.

The present invention is not limited to the above embodiments but can be modified to any suitable structure of the filter nor limited to two kinds of filter elements. Even if two kinds of filter elements are used, it is not necessary to provide any space therebetween but adhere them to each other.

According to the present invention, the cleaning fan is directly connected to the main motor, so that the whole structure can be simplified and the assembly is made compact. Further, the elaborated structure of the filter can prolong a cycle of maintenance. The construction of the cleaning brush detachable to the electrostatic latent image retentive member is preferable for obtaining a plurality of duplicated copies from the same electrostatic latent image, and the detachment and exchange of the cleaning brush can easily be carried out.

What is claimed is:

1. An improved cleaning device for an electro photographic apparatus, said apparatus having a cleaning brush rotatable adjacent to an electrostatic latent image retentive member for cleaning unnecessary residual toner particles adhered to the electrostatic latent image retentive member; a cleaning fan for producing an air flow to draw off the toner particles scraped by the cleaning brush; and a cleaning filter for collecting the sucked toner particles, the improvement comprising: a duct fixed to the device and enclosing the cleaning brush, the cleaning filter and the cleaning fan therein; first and second swinging arms pivotally mounted at outside of both sidewalls of the duct; a first brush supporting shaft rotatably mounted to the first swinging arm; an auxiliary arm detachably mounted to the second swinging arm having a second rotatable brush supporting shaft; an opening provided to the first sidewall of the duct, capable of extending through the second brush supporting shaft; another opening provided to the second sidewall of the duct capable of passing at least said brush therethrough; a detachable lid having a further opening capable of passing the second brush supporting shaft therethrough, to fully cover said another opening for detachably engaging the cleaning brush to the electrostatic latent image retentive member and to remove the cleaning brush from outside of the duct.

2. A cleaning device as claimed in claim 1, wherein: a driving source for swinging the swinging arms is connected to the first swinging arm.

3. A cleaning device as claimed in claim 1, wherein: a driving source for rotating the cleaning brush is provided to the first swinging arm.

4. A cleaning device as claimed in claim 1, wherein: one side of the swinging arms is separably secured for detachably mounting a part of the arms and the cleaning brush is detached from the housing in the direction parallel to the pivot shaft of the swinging arms.

* * * * *